United States Patent [19]

Podrapsky et al.

[11] 4,395,981

[45] Aug. 2, 1983

[54] MAGNETO-SEMICONDUCTOR IGNITION SYSTEM

[75] Inventors: Jiri Podrapsky, Buchschwabach; Josef Orova, Schwabach, both of Fed. Rep. of Germany

[73] Assignee: Robert Bosch GmbH, Stuttgart, Fed. Rep. of Germany

[21] Appl. No.: 152,533

[22] Filed: May 23, 1980 (Under 37 CFR 1.47)

[30] Foreign Application Priority Data

May 23, 1979 [DE] Fed. Rep. of Germany ..... 2920831

[51] Int. Cl.³ ..... F02P 1/08

[52] U.S. Cl. ..... 123/149 D; 123/651; 123/655; 315/209 T; 315/218

[58] Field of Search ..... 123/651, 655, 656, 149 D, 123/647; 315/209 T, 218

[56] References Cited

U.S. PATENT DOCUMENTS

| | | | |
|---|---|---|---|
| 3,374,778 | 3/1968 | Dixon | 123/647 |
| 3,864,622 | 2/1975 | Haubner et al. | 315/209 T |
| 3,878,824 | 4/1975 | Haubner et al. | 123/651 |
| 3,894,525 | 7/1975 | Haubner et al. | 123/651 |
| 3,938,491 | 2/1976 | Mazza | 123/149 D |
| 4,188,930 | 2/1980 | Santi | 123/651 |

*Primary Examiner*—Charles J. Myhre
*Assistant Examiner*—Andrew M. Dolinar
*Attorney, Agent, or Firm*—Frishauf, Holtz, Goodman & Woodward

[57] ABSTRACT

To suppress negative half-waves derived from a magneto armature and not used for ignition without use of external damping networks, the semiconductor switch controlling current flow, and abrupt turn-off to initiate an ignition event, is formed as a monolithic semiconductor element, and the inherent inverse diode of the monolithic element is utilized to pass the reverse voltage half-waves. To prevent damage to the inherent diodes due to over-voltage or current overloading, a damping resistance element is connected in series with the main current carrying path of the monolithic circuit elements, preferably a Darlington transistor, which, preferably, is a semiconductor resistor having a preferred current passage characteristic in the same direction as the current flow through the Darlington transistor, for example a Zener diode, a resistor, or a series of diodes polarized like the inverse diode, bridged by a diode conducting in the same direction as the Darlington transistor, or the like.

2 Claims, 5 Drawing Figures

MAGNETO-SEMICONDUCTOR IGNITION SYSTEM

The present invention relates to an ignition system for internal combustion engines, and more particularly to a magneto-type ignition system utilizing a controlled semiconductor switch to interrupt current flow in the primary circuit of an ignition device, such as a magneto or a separate ignition coil, to initiate an ignition pulse for a spark plug.

BACKGROUND AND PRIOR ART

Transistorized magneto ignition systems are known, and reference is made to U.S. Pat. Nos. 3,864,622 and 3,894,525, both Haubner, Hofer and Schmaldienst, and assigned to the assignee of the present applications. In these ignition systems, an ignition transistor is controlled to become conductive upon start of a positive voltage half-wave derived from the magneto; at the ignition instant, the primary current through the ignition transistor is abruptly interrupted, causing the ignition pulse. The negative voltage half-waves derived from the magneto generator have to be damped within the primary circuit so that the ignition transistor, and other circuit elements, such as control circuits for the ignition system, are not damaged by excessive reverse voltages, loading the ignition transistor, and the other components, in their inverse or blocking direction. Short-circuiting of the negative voltage half-waves by providing a simple diode in parallel to the magneto generator is not suitable since the short-circuit current of the negative half-waves causes a time shift, due to armature reaction, of the positive half-wave necessary for ignition, which results in undesirable retardation of the ignition instant. The aforementioned referenced U.S. Pat. No. 3,864,622, Haubner et al., thus utilizes a damping element connected in parallel to the magneto generator which consists of a diode and a serially connected Zener diode in order to limit the negative half-waves in the primary current to the response level of the Zener diode. The referenced U.S. Pat. No. 3,894,525, Haubner et al., approaches the solution to the problem in a somewhat different way and damping of the negative half-waves is effected by an ohmic resistor, rather than using a Zener diode, and connected in the primary circuit of the magneto generator.

Both solutions in accordance with the prior art have the advantage that the negative half-waves in the primary circuit are damped while a high amplitude of the primary current at the ignition instant, and thus high secondary flash-over voltage pulses can be obtained, whereas retardation of the spark after the top dead center (TDC) position is limited to about zero degree. Both solutions, however, require additional circuit networks for damping of the negative half-waves and thus require additional costs in manufacture as well as in circuit components.

THE INVENTION

It is an object to improve transistorized magneto ignition systems of the type described in the referenced patents, while improving the circuits in such a way that the damping effects can be obtained without utilization of additionally connected circuit elements, connected in the primary circuit of the ignition system.

Briefly, use is made of the existing inversely connected diode if the main semiconductor controlled switching element is a monolithic Darlington transistor in order to effect damping of the positive half-waves. It is then only necessary to connect a resistance element in series with the main switching path of the Darlington circuit in order to prevent undue loading of this already existing inherent inverse diode of the monolothic semiconductor switch, typically a Darlington transistor. This resistance element may be a Zener diode or an ordinary resistor of relatively low resistance value, for example 6 ohms in a typical ignition system, or a resistor which has connected thereto an ordinary diode, a group of diodes, or a Zener diode.

The inversely connected diode which, in a Darlington transistor in monolithic construction is already present, thus can be used to dampen the negative half-waves, the inverse diode being then polarized in conductive direction. Use of a semiconductor element as the resistance element is preferred since such and element will then present a small resistance to positive half-waves arising in the primary circuit, thus providing a small damping effect to the desired half-waves, while presenting a substantially larger resistance to negative half-waves and thus effectively protecting the inverse diode against excessive current flow.

Forming the damping resistance as a Zener diode, or in combination with a Zener diode, has the advantage that it can be poled in the same conductive direction as the main conductive path of the ignition transistor and thus have very low resistance for the desired half-wave; in reverse direction, however, the Zener diode provides a limiting level of voltage across the inverse diode, the voltage level being limited to the response or breakdown voltage of the Zener diode.

DRAWINGS

Figure 1:
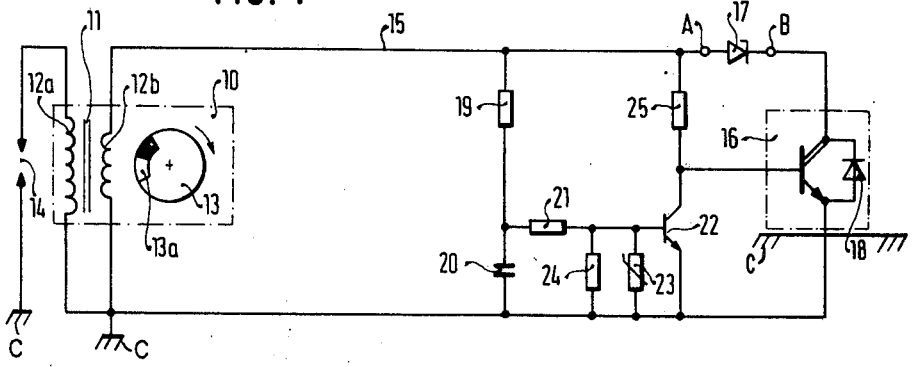
FIG. 1 shows the basic circuit of the ignition system and utilizing the concept of the present invention.

The ignition system of FIG. 1 is illustrated for use with a single cylinder internal combustion engine of the Otto type, having an ignition magneto 10 with a rotating field 13 in magnetically coupled relation to an armature having a core 11 and secondary and primary coils 12*a*, 12*b* which, simultaneously, form the ignition coils of the ignition system. The armature 11, secured to the internal combustion engine (not shown), cooperates with a rotary magneto system 13 having a permanent magnet 13*a* thereon. The magneto system 13 rotates with rotation of the internal combustion (IC) engine. The secondary 12*a* of the armature of the ignition magneto is connected to a spark plug 14, forming a spark gap. The primary 12*b* is connected to a primary circuit 15. The primary circuit 15 includes the main switching path of a Darlington ignition transistor 16. Ignition transistor 16 is an npn conductive power transistor in monolithic construction. The emitter thereof as well as one terminal of the primary 12*b* are connected to ground or chassis C of the engine. The other terminal of the primary 12*b* is connected through a damping resistance element 17, shown as a Zener diode, to the collector of the Darlington ignition transistor 16. An inverse, inherent diode 18 is connected across the main switching path of the ignition transistor 16. This inverse diode 18, together with the damping resistance element 17, is used to dampen the negative voltage half-waves which arise in the primary circuit 15.

The Darlington ignition transistor 16 is controlled by a control circuit which, as such, is known—see the referenced Haubner et al patents. The control system includes a timing circuit comprising a resistance 19 and a serially connected capacitor 20, connected across the primary circuit 15, the capacitor having one terminal connected to ground or chassis. The junction between resistor 19 and capacitor 20 is connected over a coupling resistance 21 with the base of an npn control transistor 22, the main conductive or switching path of which is connected in parallel to the base-emitter control path of the Darlington ignition transistor 16. A temperature dependent resistor 23 is connected in parallel to a further resistor 24 and between base and emitter or chassis connection of the control transistor 22. A resistor 25 connects the collector of transistor 22, and hence the junction of the collector and the base of transistor 16 to the other terminal of the primary of coil **12*b*, that is, of the primary circuit 15, and ahead—with respect to the magneto generator—of the terminal A of resistance element 17**.

The resistance element 17 is formed by a Zener diode, the cathode of which is connected to a terminal B which, in turn, is connected to the collector of the ignition power Darlington transistor 16.

Figure 2:
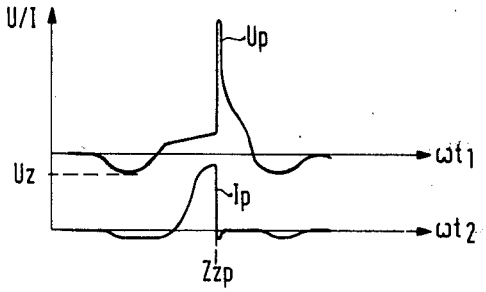
FIG. 2 shows two superimposed graphs, in which the top graph is a graph of voltage in the primary circuit, and the bottom graph illustrates current in the primary circuit of FIG. 1.

Operation, with reference to FIG. 2: The ordinate of the upper graph of FIG. 2 illustrates the voltage wave shape, with respect to the time axis $\omega t_1$; the lower graph illustrates current in the primary circuit 15 with respect to the time axis $\omega t_2$.

The permanent magnet **13*a* of the magneto system, upon operation of the engine, is rotated to move past the armature 11 of the magneto system 10. First, a small negative voltage half-wave will be generated in the magneto generator armature 11 due to build-up of the magnetic field. Upon flux reversal in the armature 11, a positive, substantially larger voltage half-wave will be generated which is used for ignition. The subsequent small negative half-wave is induced due to decay of the magnetic field as the magnet 13*a* moves away from the armature 11**.

The negative voltage half-waves in the primary circuit 15 load the inverse diode 18 integrated with the Darlington transistor 16 which, with respect to the negative half-waves, is poled in conductive direction. Thus, current will flow through the inverse diode 18. The damping resistance element 17, in FIG. 1 the Zener diode, limits the voltage, as the speed increases, to the breakdown voltage Uz (FIG. 2) of the Zener diode. The Zener diode 17 is poled to pass the positive primary voltage half-waves, that is, the Zener diode is poled in conductive direction with respect to the positive voltage half-waves.

Upon initiation of a positive voltage half-wave, the Darlington ignition transistor 16 is first controlled to conductive state by the resistor 25 connected between the upper bus (FIG. 1) of the primary circuit 15 and the base of the Darlington transistor. This, effectively, short-circuits the primary circuit 15. The threshold voltage of Zener diode 17, poled in conductive direction, is utilized to control the Darlington transistor 16 through the resistor 25 to saturation, thereby increasing the primary current. The positive voltage half-wave in the primary circuit additionally charges the control capacitor 20 over the resistor 19. The charge rate across the capacitor 20 is so arranged that at the ignition instant Zzp the primary current Ip has reached a peak value and the voltage at the control capacitor 20 exceeds the response voltage of the control transistor 22. Transistor 22 is now controlled to switch over to conductive state. As soon as control transistor 22 becomes conductive, the control path of the Darlington ignition transistor 16 is short-circuited by the now conductive collector-emitter path of the control transistor 22, which will cause immediate blocking of the ignition transistor 16. The change-over of the ignition transistor 16 from conductive to blocked state is accelerated by rise of primary voltage upon disconnection of the primary current Ip in abrupt or pulse-like manner which is transferred over resistors 19 and 21 to the control path of the control transistor 22. Control transistor 22 will rapidly go into saturation which effectively short-circuits the control path of the ignition transistor 16. The accelerated disconnection of the primary current Ip causes a pulse-like abrupt change in flux in the armature 11 which in turn causes induction of a high-voltage pulse in the secondary **12*a* of the magneto armature, resulting in an ignition flash-over at the spark plug 14**.

The control transistor 22 will remain conductive only until the positive voltage half-wave of the primary circuit has decayed, and the control capacitor 20 has discharged over the resistor 21 and resistors 23, 24 and the conductive transistor 22 up to its threshold voltage. The subsequent smaller negative voltage half-wave, which loads the switching path of the Darlington ignition transistor 16 in blocking direction, is then again passed by the inverse diode 18—connected with respect to the negative half-wave in conduction direction, and limited to the Zener voltage by the Zener diode 17 in series therewith to, effectively, the Zener breakdown voltage of diode 17.

The foregoing cycle repeats upon each rotation of the magneto system 13, that is, each time a magnet **13*a* passes by the armature 11**.

Figure 3:
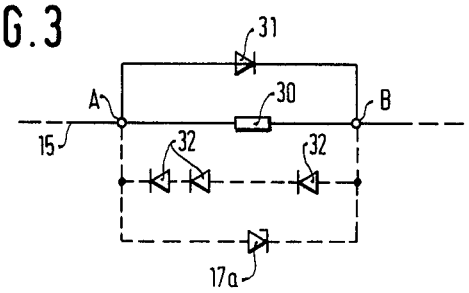
FIG. 3, 4 and 5 are fragmentary circuits showing alternate arrangements for the resistance element in series with the main switching path of the switching transistor of the circuit.
Figure 4:
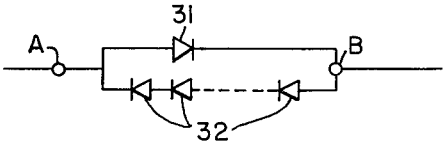
Figure 5:
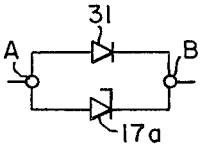

Various changes and modifications may be made, and specifically it is possible to utilize various electrical components for the damping element 17. FIG. 1 illustrates damping element 17 as a Zener diode, poled in conductive direction with respect to primary current flow in the positive half-wave. FIGS. 3, 4 and 5 illustrate, in fragmentary form, other circuit elements which can be connected between terminals A and B of the primary circuit.

In one suitable FIG. 3, the damping resistance element is a resistor 30 which is bridged by a diode 31 poled in conductive direction to pass the positive voltage half-wave needed to store electromagnetic energy in the primary of the ignition system, that is, upon conduction of the controlled semiconductor switch 16. Diode 31, together with the ohmic resistor 30, forms a composite semiconductive resistance circuit which, in one direction of current flow, has a small resistance value and, in the opposite direction of current flow, has a high resistance value. This arrangement has some advantages with respect to the Zener diode 17 of FIG. 1. As the speed of the engine increases, the primary current does not rise during negative half-waves as fast as when a threshold switch is used. Thus, the beginning of the positive primary half-wave is not delayed due to armature reaction by a substantial degree. Such delay may lead to retardation of the ignition time, that is, of the timing of the ignition event Zzp as the speed increases. The resistor 30, however, can dampen the first negative voltage half-waves to such an extent that, even in an upper range of speed, the corresponding voltage half-wave in the secondary 12*a* of the armature does not cause a false or stray ignition flash-over at the spark plug 14. Use of an ohmic resistor 30 in the ignition system according to FIG. 1 thus has some advantages; a suitable resistance value is, for example, about 6 ohms, which results in optimum damping of the negative voltage half-waves in the primary circuit. A high amplitude of primary current is obtained at the ignition instant, with minimum spark retardation even in upper speed ranges and minimal damping of secondary voltages; the negative half-waves are limited to values which do not and cannot cause damage to the semiconductor 16 by overloading the inverse diode 18.

Additional resistance elements, such as diodes 32 can be used in addition to the resistor 30, although not required, and thus shown in broken lines. It is also possible to then eliminate resistor 30, see FIG. 4, and use only the diodes 32 to form which, as can be seen, have the same polarity direction as the inverse diode 18 of the ignition transistor 16. Diode 31 is connected in parallel to the diode chain 32. The individual voltage drops across the respective diodes 32 thus provide for current limiting in the overall circuit. It is also possible to include an additional Zener diode 17*a*, polarized as shown in FIGS. 1 and 3, which forms the damping resistance for negative voltage half-waves in the primary circuit 15, and combined with diode 31 and resistor 30 or with diode 31 only see FIG. 5. Diode 31, typically, has a voltage drop of 0.7 V. Combining a diode 31 with a Zener diode 17*a* has the advantage that Zener diodes can be used which have responsive voltages in the conductive direction which are substantially higher than 0.7 V, and thereby providing for higher current in the primary circuit 15 when the controlled semiconductor switch 16 is in conductive state.

Various other changes and modifications may be made, and the invention is not limited to the ignition system illustrated in FIG. 1, or the examples of damping resistances 17 which are shown and described, since other damping resistances in the primary circuit of a transistor magneto ignition system can be used. For example, the diode 31 (FIG. 3) is not strictly necessary, so that only an ohmic resistor 30 in the primary can be used to dampen the negative voltage half-waves. This system, while extremely simple, has the disadvantage, however, that the positive voltage half-wave, used for ignition, will also be damped by the resistor 30.

The Darlington ignition transistor becomes warm and, indeed, may become hot due to the high switching power thereof. For good heat dissipation, it is thus desirable to connect the collector and the primary winding 12*b* of the ignition system 11 to the chassis C, not as shown in FIG. 1 where the emitter and the other terminal is connected to chassis, so that the chassis of the system itself may form a heat sink or heat dissipation surface. If this is undesirable for other circuit reasons—for example the connection of capacitor 20, resistors 23, 24 and transistor 22, the circuit can stay as shown, with an interposed insulator between the chassis connection and chassis itself and mechanical connection of the so arranged unit to a heat sink, for example the structure of the IC engine. If the collector of the transistor 16, and the corresponding terminal of the primary 12*b* are connected to chassis, the damping resistance can then be connected between the emitter terminal of the semiconductor 16 and the junction to the emitter of transistor 22. The damping resistance can also be connected at other places in the circuit in advance of the connection to the primary of coil 12*b*. For better control of the Darlington transistor 16, the resistance element 17 can be left as shown at the collector terminal and, instead, mechanically connecting the collector to the chassis, but electrically insulating the collector therefrom.

It is an essential feature of the invention that the inverse diode 18 of the controlled semiconductor switching transistor, typically a Darlington ignition transistor, or some other monolithic semiconductor switching element, is used to dampen those voltage half-waves of the primary circuit which are not needed for ignition, by being connected in series with a damping resistance element in the primary circuit. Thus, optimum damping of the half-waves derived from the magneto 10 and which are not needed for ignition can be obtained without requiring additional circuit networks. Thus, the concept of the invention can be applied to ignition systems which have a separate ignition coil, in which the primary is connected in series with the winding of the magneto which generates the ignition energy. The damping resistance, in this instance also, is connected in advance or behind the ignition path of the ignition transistor—looked at from the output terminals of the magneto generator.

Various other changes and modifications may be made within the scope of the inventive concept, and features described in connection with any one of the embodiments may be used with any of the others.

We claim:

1. Internal combustion engine magneto ignition system for a spark gap having a magneto generator (10) to generate ignition energy, including a magnet system (13) coupled to rotate with the engine and an induction coil (12*b*) in magnetically coupled relation to the magnet to furnish alternating voltage for conversion to a high voltage pulse to form an ignition pulse for the spark gap (14);

a semiconductor switch (16) and an inherent inverse diode (18) comprising a single monolithic integrated circuit element, the semiconductor switch having its main switching path connected to the induction coil and forming a primary circuit with;

control circuit means (19, 20, 22, 25) connected to the induction coil and to the controlled semiconductor switch and controlling said switch to change from conductive to nonconductive state, and thereby generate the ignition pulse;

and a Zener diode (17, 17*a*) connected in series with the main switching path of the controlled semiconductor switch (16) in the primary circuit to remove high voltage conditions from the inherent inverse diode (18) during half-waves derived from the induction coil which are of a polarity causing conduction from the inverse diode and permits conduction of the inverse diode only after the breakdown voltage of the Zener diode has been exceeded to form a damping resistance circuit for the inverse diode.

2. System according to claim 1 further including a blocking diode (31) connected in parallel with said Zener diode, the blocking diode being poled in conductive direction when the controlled semiconductor switch (16) is conductive.

* * * * *